US005423703A

United States Patent [19]

Lorenzen

[11] Patent Number: 5,423,703

[45] Date of Patent: Jun. 13, 1995

[54] OUTBOARD MOTOR FLUSHING SYSTEM

[76] Inventor: Thomas H. Lorenzen, 326 Southwind Ct. #205, North Palm Beach, Fla. 33408

[21] Appl. No.: 319,666

[22] Filed: Oct. 7, 1994

[51] Int. Cl.[6] ..... B63H 21/10

[52] U.S. Cl. ..... 440/88; 440/113

[58] Field of Search ..... 440/88, 900, 113; 134/167 R, 168 R, 169 A

[56] References Cited

U.S. PATENT DOCUMENTS

| | | | |
|---|---|---|---|
| 3,002,488 | 10/1961 | Guhlin | 115/17 |
| 3,931,828 | 1/1976 | Lawler | 134/167 |
| 4,052,953 | 10/1977 | Patel | 134/167 |
| 4,121,948 | 10/1978 | Guhlin | 134/100 |
| 4,246,863 | 1/1981 | Reese | 440/113 |
| 4,359,063 | 11/1982 | Carlson | 134/167 |
| 4,540,009 | 9/1985 | Karls | 134/167 |
| 4,589,851 | 5/1986 | Karls | 440/88 |
| 4,973,276 | 11/1990 | Mavrelis | 440/113 |
| 5,051,104 | 9/1991 | Guhlin | 440/88 |
| 5,071,377 | 12/1991 | Saunders et al. | 440/88 |

*Primary Examiner*—Edwin L. Swinehart

*Attorney, Agent, or Firm*—William M. Hobby, III

[57] ABSTRACT

An outboard motor flushing apparatus for flushing a marine engine outboard propulsion unit includes a pair of sealing elements for covering the cooling water inlets of a marine engine propulsion unit. A U-shaped sealing element retainer has a pair of arms and has one of the sealing elements attached to each arm. An elongated hollow rigid pipe has a handle on one end and a metal rod on the other end thereof. The metal rod has an attaching clamp for removably attaching the metal rod and hollow rigid pipe to the U-shaped retainer. The hollow rigid pipe has a water coupling on each end thereof and one of the couplings has a flexible tube attached thereto into one of the sealing elements for conveying water from the hollow tube to the sealing element and the cooling water inlets of an outboard motor. The coupling at the other end of the hollow rigid pipe is attached to a water hose. The handle end of the rigid pipe has a water control valve on the handle for controlling the flow of water and both the handle end and the metal rod end are removably attached to a pipe so that the pipe can be interchanged for different lengths.

7 Claims, 1 Drawing Sheet

OUTBOARD MOTOR FLUSHING SYSTEM

BACKGROUND OF THE INVENTION

The present invention relates to an outboard motor flushing system for flushing a marine engine outboard propulsion unit and especially to an outboard motor flushing system having a remote attaching handle and water control system.

In the past, a wide variety of systems have been provided for flushing of corrosive materials from a drive unit of a marine engine outboard propulsion unit. In particular, the flushing systems are used to flush the cooling systems after the marine engines have been used in salt water to purge the system of the corrosive effects of salt water by flushing fresh water through the cooling system. Examples of such flushing systems can be seen in a number of prior art U.S. patents including the Lawler patent, U.S. Pat. No. 3,931,828, for a self-gripping flushing accessory which is attachable over the water inlet of an outboard motor without the need of additional fasteners by the use of a U-shaped spring unit attached to a pair of sealing cups. In the Carlson patent, U.S. Pat. No. 4,359,063, a Spring-Biased Flushing Accessory for Outboard Motors works similar to the Lawler patent except that an additional spring is added to the U-shaped retainer member and both of the spring arms are hinged to a bracket. The Guhlin patent, U.S. Pat. No. 5,051,104, is a Flushing Device for a Motorboat Engine which has a pair of sealing units held by a U-shaped spring. The Karls patent, U.S. Pat. No. 4,540,009, is a Flushing Device for Outboard Motors which is held to the cooling water inlets by a rod passing through from one side to the other of the prop and in which the sealing cups are tightened by sliding a spring latch on the rod. The Patel patent, U.S. Pat. No. 4,052,953, is a Flushing Device for Outboard Motors which uses a strap that attaches around the prop to hold sealing cups against the prop and over the water inlets. The Karls patent, U.S. Pat. No. 4,589,851, is a Flushing Device for Outboard Motors which uses a mounting bracket to hold a resilient cup which in turn has a hose connector attached thereto. The Guhlin patent, U.S. Pat. No. 3,002,488, is another Flushing Device for Outboard Motors which allows a water hose to be attached to the cooling system of the outboard motor prop. The Guhlin patent, U.S. Pat. No. 4,121,948, is another Universal Flushing Device which attaches the seals for the cooling system with a strap.

The Mavrelis patent, U.S. Pat. No. 4,973,276, is an Outboard Motor Flushing Apparatus which attaches sealing cups to cover the water inlets of an outboard prop unit with a U-shaped spring and has a water hose connected to one of the sealing units. This patent provides an elongated rigid handle formed with a planar forward terminal end surface and a clamp member for clamping to the U-shaped spring for use in securing the motor flushing unit to an outboard motor prop.

In contrast to these prior patents, the present invention is an outboard motor flushing system for flushing a marine engine outboard propulsion unit which also provides an elongated rigid hollow handle removably attached to a U-shaped spring bracket for positioning the flush unit onto the outboard propulsion unit and which also has the flushing water fed through the pipe and through separate control valves on the handle to thereby allow control of the flow of flushing water and to allow for the rapid testing of the sealing elements when remotely attached with the elongated handle. More precise control of the attachment with the elongated handle is provided with an elongated metal rod attached to one end for attachment to the U-shaped spring bracket, which metal rod can be rigid but bent to an angle for more convenient attachment of the sealing elements and spring brackets.

SUMMARY OF THE INVENTION

An outboard motor flushing apparatus for flushing a marine engine outboard propulsion unit includes a pair of sealing elements for covering the cooling water inlets of a marine engine propulsion unit and a U-shaped sealing element retainer having a pair of arms and having one of the sealing elements attached to each arm. An elongated hollow rigid pipe has a handle on one end and a metal rod on the other end thereof in which the metal rod has an attaching clamp for removably attaching the metal rod and hollow rigid pipe to the U-shaped retainer. The hollow rigid pipe has a water coupling on each end thereof and one of the couplings has a flexible tube attached thereto and to one of the sealing elements for conveying water from the hollow pipe to the sealing element and to the cooling water inlets of an outboard motor. The coupling at the other end of the hollow rigid pipe is attached to a water hose. The handle end of the rigid pipe has a water control valve on the handle for controlling the flow of water and both the handle end and the metal rod end are removably attached to a pipe so that the pipe can be interchanged for different lengths.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
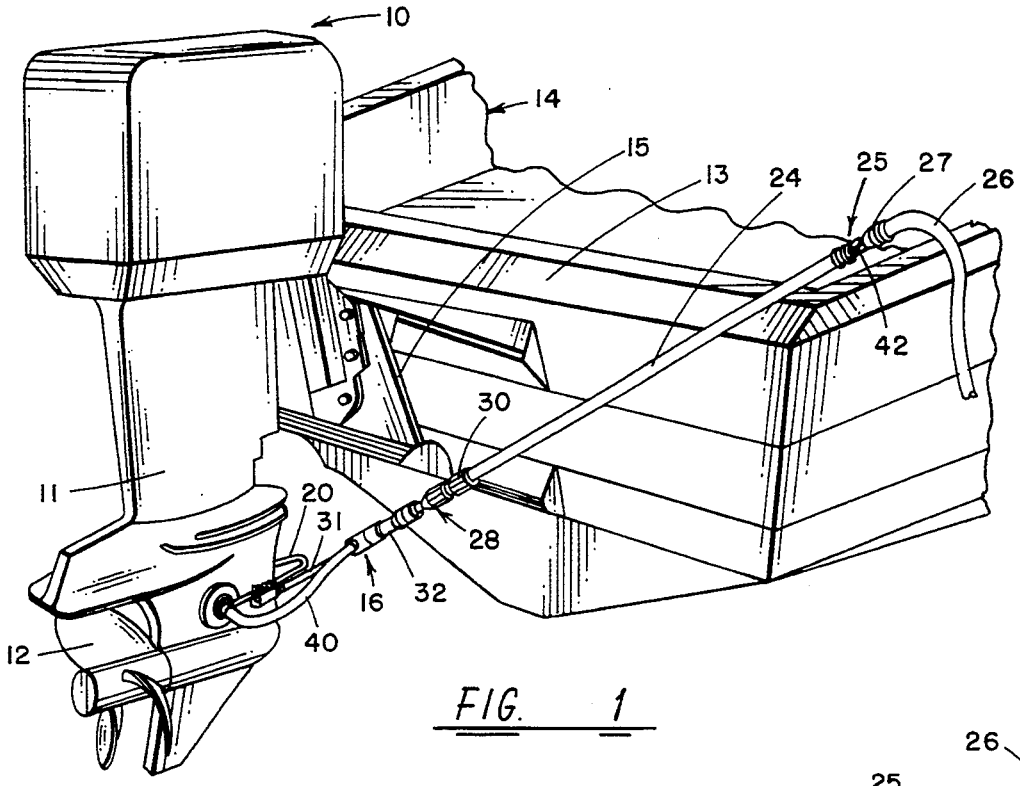
FIG. 1 is a perspective view of an outboard propulsion unit attached to the transom of a boat having the flushing system of the present invention attached thereto.
Figure 2:
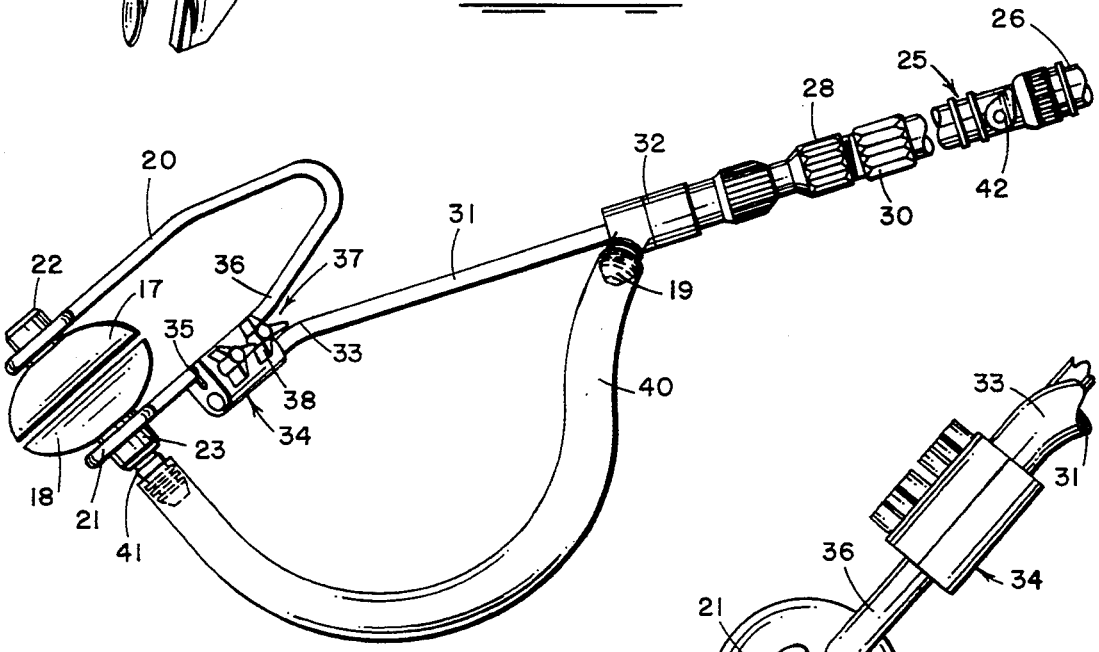
FIG. 2 is a partial elevational view of the outboard flushing unit of the present invention.
Figure 3:
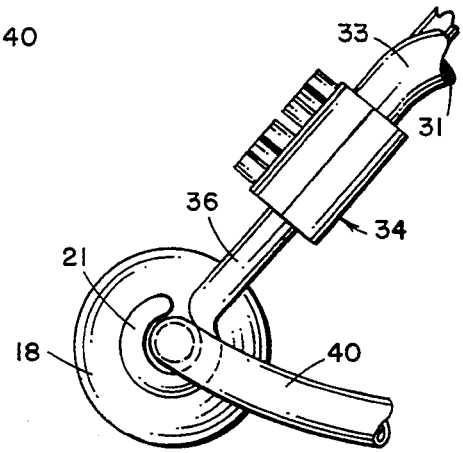
FIG. 3 is a side elevation of the sealing elements and handle attachment of the present invention.

Referring to the drawings, FIGS. 1 through 3, an outboard motor 10 is seen having a prop unit 11 having a propeller 12 attached thereto. The motor 10 is attached to the transom 13 of a boat 14 with an outboard motor mounting bracket 15. An outboard motor flushing apparatus 16 has a pair of sealing elements or cups 17 and 18 held together with a U-shaped spring bracket 20 so as to be slid over the outboard motor prop 11 to cover the cooling inlets in the prop, as shown in FIG. 1. The U-shaped spring bracket has an eye 21 on each end thereof for gripping the rear protrusion 22 of the sealing cup 17 and 23 of the sealing cup 18. An elongated hollow rigid pipe 24 may be made of a thin wall conduit metal tube or the like and has a handle coupling 25 on one end having a water hose 26 attached to a water hose coupling 27. The opposite end of the pipe 24 has a compression coupling 28 for attaching to the end of the tube by rotating the handle 30 to compress onto the tube.

The coupling 28 is hollow and has a threaded tube coupling 30 attached to the end thereof. A metal rod 31 extends from the end of the coupling portion 32. The metal rod 31 has a bend 33 therein and has an attaching bracket 34 attached to the end of the metal rod 31. Clamping member 34 has a tubular opening 35 therethrough for the arm 36 of the spring bracket 20 to pass through. Bracket 34 has a pair of threaded fasteners 37, each having a handle 38 for clamping the bracket 34 onto the arm 36. The tube coupling extension 19 has a flexible tube 40 attached thereto while the sealing member 18 has a threaded coupling 41 extending therefrom to which the other end of the tube 40 is attached.

The water from a water hose 26 passes through the handle 24 and out the coupling 30 into the tube 40 and into the coupling 41 and through the sealing element 18 into the cooling system of the outboard motor 10. A valve 42 is located in the handle unit 25 for controlling the flow of water including turning the water on and off at the entrance to the pipe 24 and also for varying the flow as needed.

Thus, the present unit can be readily attached from within the boat or from the side of the boat by using the handle 25 and pipe 24 to position the sealing elements 17 and 18 over the prop unit 11 cooling inlets, which are shown covered in FIG. 1, to align them to cover the cooling inlets. The water flow can be controlled with the valve 42 to test the alignment and seal of the sealing unit 17 and 18 and then, once a good seal is reached over the water inlets, the water can be opened to the desired flow with the valve 42 on the remote end of the handle. Each end of the rigid pipe 24 is removably attached with either compression fittings or with threaded attachments.

The present outboard motor flushing system can be readily adapted for different situations by changing the pipe 24 to different lengths for a particular person's requirements and the metal rod 31 can be bent at the bend 33 and the bracket 34 adjusted so that the unit can be easily used from any position as required by an individual user. It should be clear at this time that an outboard motor flushing system has been provided for flushing marine engine outboard propulsion units which is remotely attached and controlled with an extension to the normal flushing unit and brackets which greatly enhances the attachment and use of a flushing unit. However, the present invention is not to be considered as limited to the forms shown which are to be considered illustrative rather than restrictive.

I claim:

1. An outboard motor flushing system for flushing a marine engine outboard propulsion unit comprising:

a pair of sealing elements for covering the cooling water inlets of a marine engine outboard propulsion unit, at least one of said sealing elements having a passageway for supplying water to one of said cooling water inlets and having a coupling extending therefrom for attaching a water hose;

a sealing element retainer has a pair of arms and has one sealing element attached to each arm;

an elongated rigid pipe has a handle on one end and a metal rod on the other end thereof, said metal rod having an attaching member for removably attaching said elongated rigid pipe to said sealing element retainer, said elongated rigid pipe having a water coupling on each end thereof, one said water coupling having a flexible tube attached thereto and to said sealing element coupling extending therefrom for conveying water from said elongated rigid pipe to said sealing element and cooling water inlets and the other said coupling being a water hose coupling, whereby an elongated rigid pipe allows for the attachment of an outboard motor flushing unit and the control of the flow of water thereto.

2. An outboard motor flushing system for flushing a marine engine outboard propulsion unit in accordance with claim 1 in which said elongated rigid pipe has a water control valve on the handle end thereof for controlling the flow of water to said cooling water inlets.

3. An outboard motor flushing system for flushing a marine engine outboard propulsion unit in accordance with claim 2 in which said elongated rigid pipe has removable end portions allowing the replacement of said elongated rigid pipe to thereby change the length of said elongated rigid pipe.

4. An outboard motor flushing system for flushing a marine engine outboard propulsion unit in accordance with claim 3 in which said metal rod is a bent metal rod having a bend positioned for manipulating said sealing element retainer for attaching said outboard motor flushing system to said marine engine outboard propulsion unit.

5. An outboard motor flushing system for flushing a marine engine outboard propulsion unit in accordance with claim 4 in which said metal rod attaching member is a clamp having a plurality of threaded fasteners for clamping said clamp to said sealing element retainer.

6. An outboard motor flushing system for flushing a marine engine outboard propulsion unit in accordance with claim 5 in which said metal rod attaching clamp is fixedly attached to said metal rod.

7. An outboard motor flushing system for flushing a marine engine outboard propulsion unit in accordance with claim 6 in which each said metal rod attaching clamp threaded fastener has a hand tightening handle formed on the end thereof.

* * * * *